United States Patent [19]

Bernard

[11] Patent Number: 4,664,430

[45] Date of Patent: May 12, 1987

[54] ELECTRICALLY OPENED AND CLOSED LATCH FOR AUTOMOBILE VEHICLE DOORS

[75] Inventor: Vincent Bernard, Remiremont, France

[73] Assignee: Compagnie Industrielle de Mecanismes en abrege C.I.M., France

[21] Appl. No.: 902,914

[22] Filed: Sep. 2, 1986

[30] Foreign Application Priority Data

Sep. 5, 1985 [FR] France ..... 85 13226

[51] Int. Cl.[4] ..... E05C 3/06

[52] U.S. Cl. ..... 292/201; 292/216; 70/279

[58] Field of Search ..... 292/201, 216

[56] References Cited

U.S. PATENT DOCUMENTS

| | | | |
|---|---|---|---|
| 2,943,880 | 7/1960 | Joachim et al. | 292/201 |
| 3,384,405 | 5/1968 | Schiele | 292/201 X |
| 3,386,761 | 6/1968 | Johnstone et al. | 292/201 |
| 3,989,287 | 11/1976 | Sheesley | 292/201 |
| 4,452,058 | 6/1984 | Noel | 292/201 X |
| 4,468,941 | 9/1984 | Bascou | 292/201 X |
| 4,518,180 | 5/1985 | Kleefeldt et al. | 292/201 |
| 4,569,544 | 2/1986 | Escaravage | 292/201 X |
| 4,588,217 | 5/1986 | Escaravage | 292/201 |
| 4,624,491 | 11/1986 | Vincent | 292/201 |

*Primary Examiner*—Thomas J. Holko
*Assistant Examiner*—Carl M. DeFranco, Jr.

[57] ABSTRACT

The latch comprises a case fixed to the door, in which is provided a cavity for a keeper (3) integral with the body of the vehicle, this case containing a bolt (4) having a notch (7) for receiving the keeper (3) and a cam (22) cooperative with the keeper (3), a disc (5) rotatively mounted on a transverse pin (6) and on which the bolt (4) is also rotatively mounted, an opening (20) being provided in the disc (5) to permit the passage of the keeper (3); the latch comprises a pawl (11) pivotally mounted on the disc (5), provided with a head portion (13) which is capable of engaging into a recess (15, 16) of the bolt (4), and a safety disc which may be manually actuated for opening or closing the latch in the event of a breakdown of the electric system (9, 42, 41, 8, 44, 46, 48, A,B) controlling the rotation of the bolt (4) and the disc (5).

11 Claims, 22 Drawing Figures

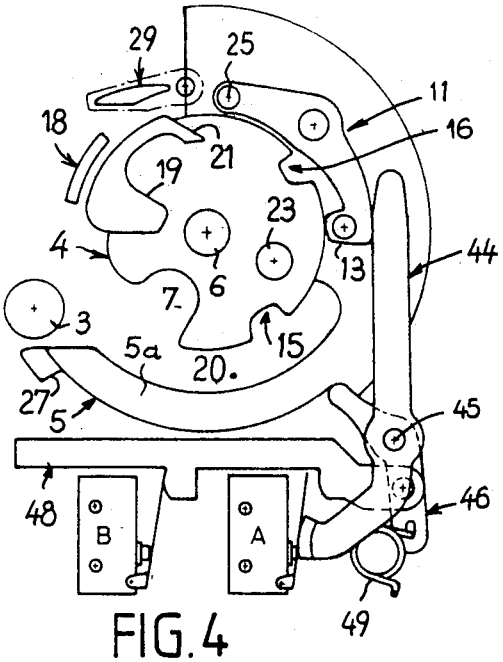
FIG. 4
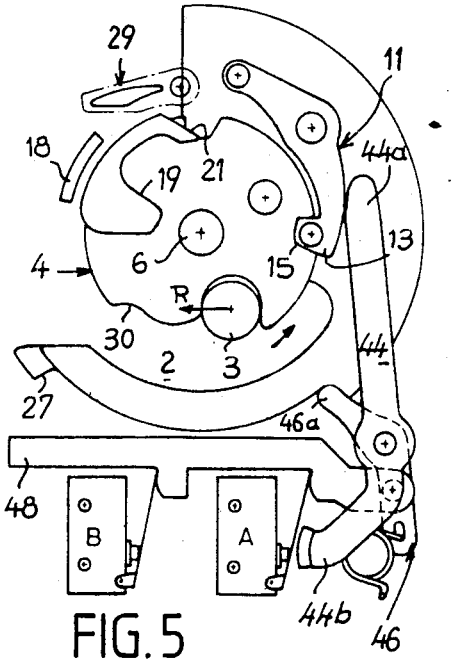
FIG. 5
FIG. 6
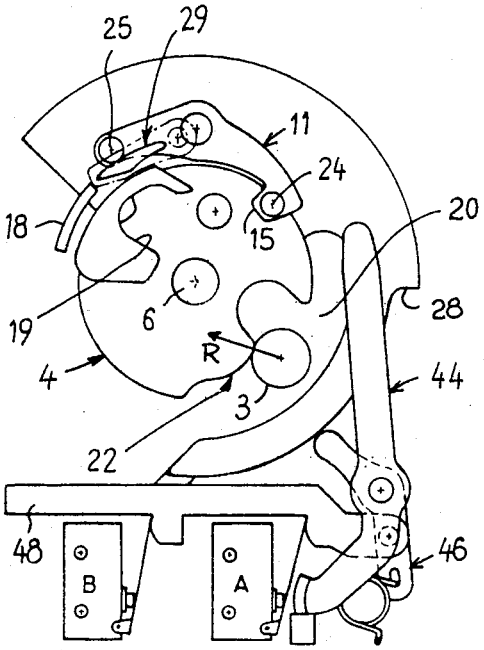
FIG. 7
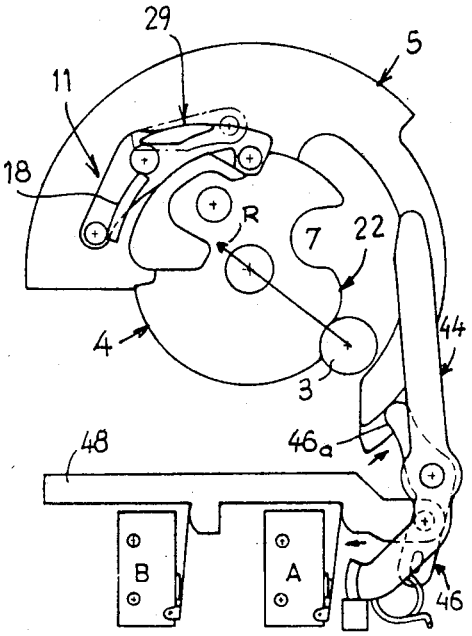

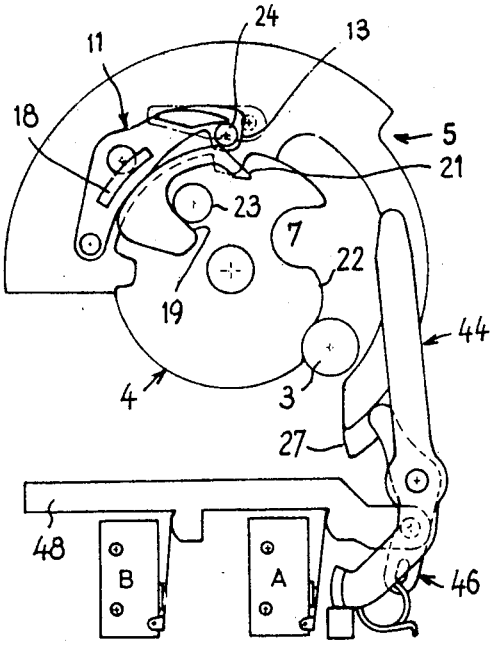
FIG. 11
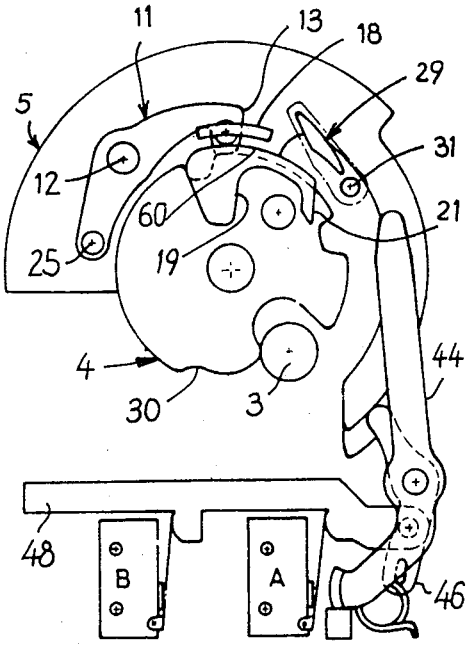
FIG. 12
FIG. 13
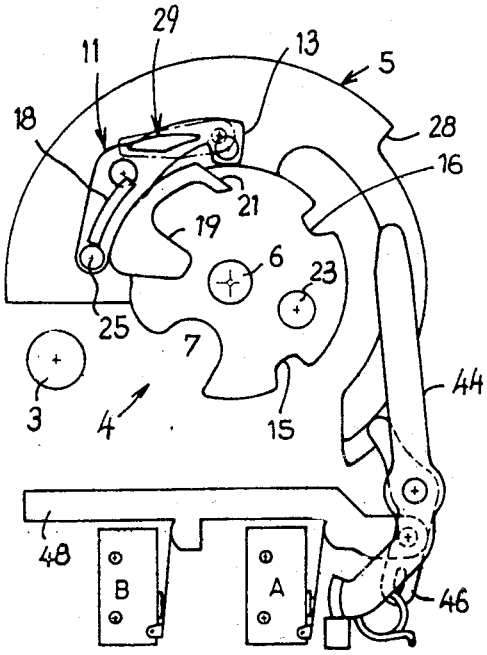
FIG. 14
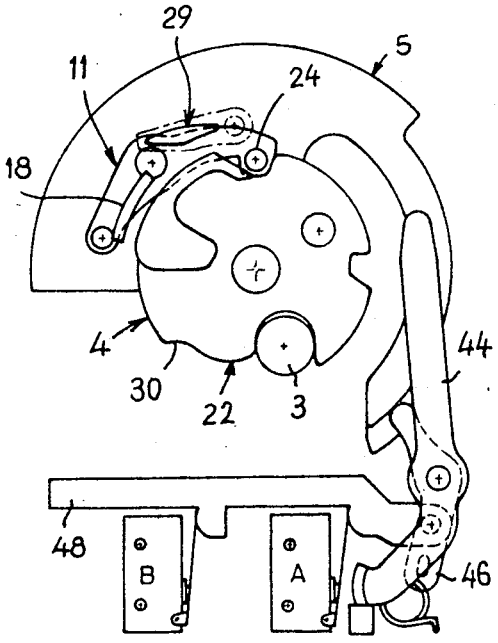

ELECTRICALLY OPENED AND CLOSED LATCH FOR AUTOMOBILE VEHICLE DOORS

The present invention relates to an electrically opened and closed latch, in particular for automobile vehicle doors.

Generally, automobile vehicle door latches comprise a case adapted to be fixed to the door and in which is provided a recess for a keeper integral with the body of the vehicle, the case containing a bolt which is capable of being driven by the keeper for closing the latch.

Heretofore, the majority of latches provided on automobile vehicles are mechanically actuated. However, the increased reliability of electric and electronic systems opens the way for electric controls which are more flexible in use and are smaller in size.

Further, the constant effort to economize energy has led the vehicle constructors to lighten the vehicles as far as possible so that the doors in particular are becoming thinner and lighter. When slamming the door closed, the low inertia of the door then results in a rebound in respect of which the sole remedy is to reduce the pressure of the sealing elements. But this results in sealing problems at high speed.

The use of electrically closed latches provides a solution to these problems by rendering a "soft" closure possible, without slamming the door, and therefore allowing strong actions of the sealing elements on light doors.

Latches comprising toggle mechanisms are known which have the drawback of not developing a progressive force in the absence of a suitable profile of the bolt.

Further, in known electric latches, in the case of a breakdown of the electric supply, it is only possible to achieve a mechanical unlocking of the latch if the breakdown occurs when the door is fully opened or closed. Consequently, if the breakdown occurs in the course of the closure or opening of the door, the door is locked in the transitional state of the latch and therefore requires the intervention of a qualified mechanic which obviously constitutes an extremely serious drawback.

An object of the invention is to provide a latch so arranged as to develop a progressive force and which moreover can be unlocked without difficulty mechanically irrespective of the moment at which a possible electric breakdown occurs.

According to the invention, the latch comprises in combination:

(a) a disc rotatably mounted on a pin fixed to the case and on which the bolt is also rotatably mounted, an opening being provided in the disc for allowing the keeper to engage therein, and a notch being provided in the bolt for receiving the keeper at the beginning of a closing cycle;

(b) means for driving the bolt in rotation in either direction during the latch closing and opening cycles, said means comprising a toothed sector integral with the disc and capable of being driven in rotation by an electric motor through a suitable kinetic chain;

(c) a pawl pivotally mounted on the disc, provided with a projecting head portion and biased by an elastically yieldable means which tends to cause the head portion of the pawl to enter one of two recesses provided in the bolt when this recess is positioned in facing relation to the head portion so as to establish a connection for driving the bolt in rotation by means of the disc;

(d) a device for controlling the motor capable of being actuated by the pawl at the beginning of a closing cycle so that the insertion of the head portion of the pawl in a recess of the bolt actuates this device which then causes the rotation of the motor in a first direction, and consequently the rotation of the disc and the bolt until the complete closure with a disengagement of the pawl relative to the control device, means being further provided cooperative with the pawl for automatically causing the stoppage of the motor at the end of a latch opening cycle;

(e) a safety disc rotatable about the same pin as the bolt and the first disc, normally locked against rotation in the case, capable of being manually unlocked in the event of breakdown of the electric circuit of the motor and driven in rotation, and this safety disc carrying fixed ramps so arranged as to be capable, from any position of the component parts of the latch, for example from the closing position, of pivoting the pawl and causing the head portion of the pawl from withdrawing from the recess of the bolt so as to release the bolt from the pawl, then driving the bolt in rotation in the opening direction to an automatically opening angular position in which the keeper assumes a driving function and drives the bolt to the complete opening of the door, the disc and its ramps also permitting the closure of the latch from the opening position or from an intermediate position.

According to a feature of the invention, a notch in the bolt is extended by a cam which cooperates with the keeper during the opening and closing cycles and whose radius of curvature progressively increases from the edge of the notch so that the centre of curvature of the successive sectors of this cam approach the pivot pin of the bolt and the direction of the resisting force exerted by the keeper against the bolt, which is first of all remote from the axis of rotation of the latter, progressively approaches it until it substantially passes through this axis at the end of the cam.

The profile of the cam of the bolt therefore enables the latch to close and lock a door with a progressive force, the reactions of the sealing elements being capable of being as much as 800 Newtons.

Further, the safety disc and the electric circuit in particular are so arranged as to permit the mechanical unlocking of the latch even if an electric breakdown occurs during an opening or closing cycle.

The closure is automatic, in that, as soon as the door is closed, and before the sealing elements start to be compressed, the keeper, by entering the latch, acts on a switch which causes the rotation of the motor in the closing direction. At the end of the closure, a toggle switch cuts off the current and reverses the polarity at the terminals of the motor.

According to another feature of the invention, a manual pressure on an opening switch causes the rotation of the motor in the opposite direction and the release of the keeper provided that no locking order had been previously given to the box supplying power to the latch.

Further features and advantages of the invention will be apparent from the following description with reference to the accompanying drawings, which illustrate an embodiment by way of a non-limiting example. In the drawings:

FIGS. 4 to 7 are partial elevational views similar to FIG. 1 illustrating the successive stages of a latch closing cycle;

FIGS. 11 and 14 are views similar to FIGS. 4 to 7 illustrating the successive stages of the mechanical unlocking of the latch in the event of an electric breakdown occurring when the latch is closed;

Figure 1:
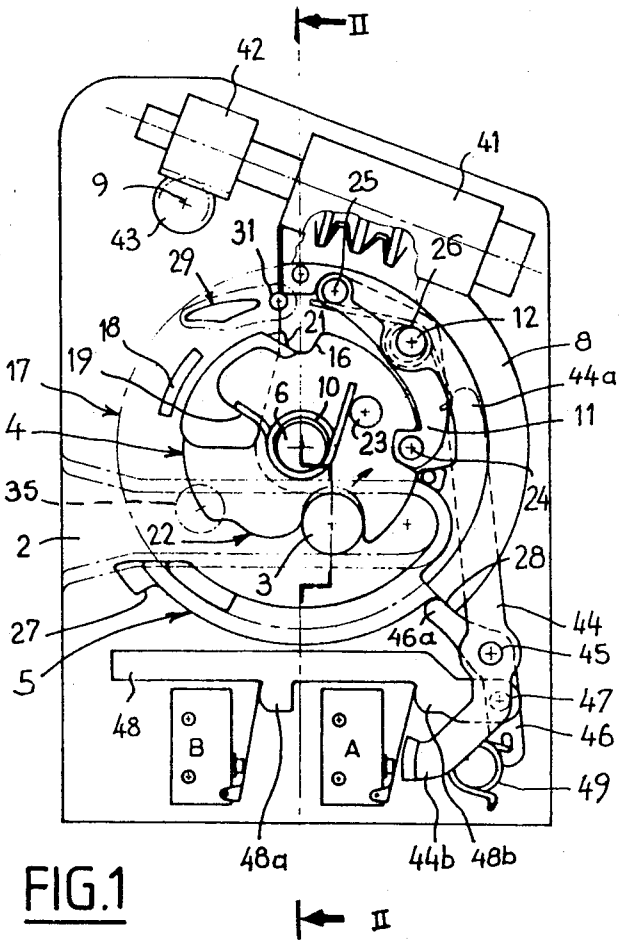
FIG. 1 is an elevational view of an embodiment of the latch according to the invention and of the corresponding keeper, a wall of the case having been removed.

The electrically opened and closed latch intended in particular for an automobile vehicle door, will be described first of all with reference to FIGS. 1, 2, 3, 15 and 16.

This latch comprises a case 1 adapted to be fixed to the door (not shown), in which is provided a cavity 2 into which is slidable a keeper 3 integral with the body of the vehicle (not shown), the latch being secured to the door.

The case 1 contains a bolt 4 capable of being driven by the keeper 3 for closing the latch.

Figure 2:
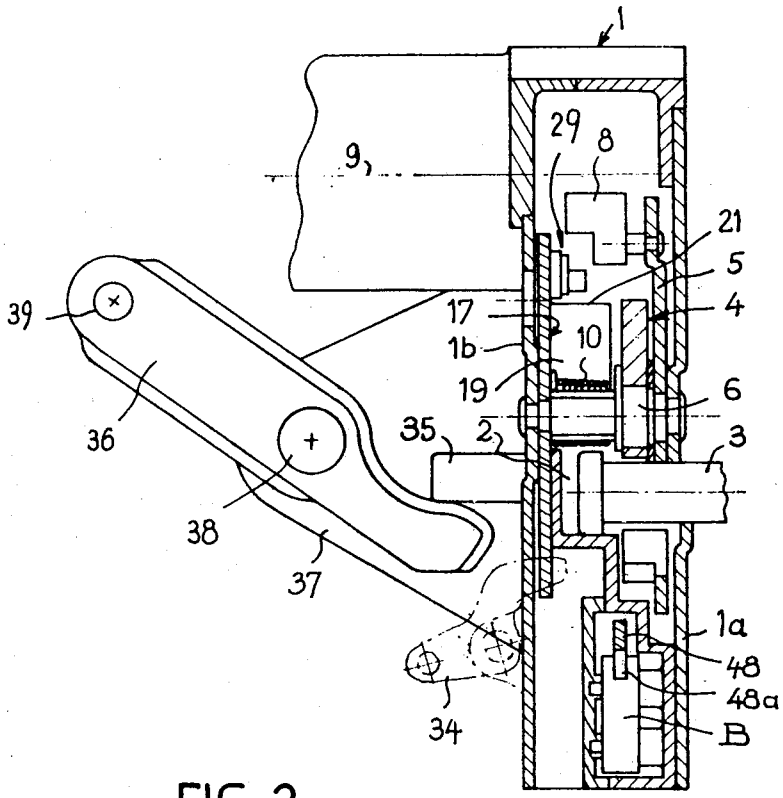
FIG. 2 is a semi-sectional, semi-elevational view taken on line II—II of FIG. 1.
Figure 3:
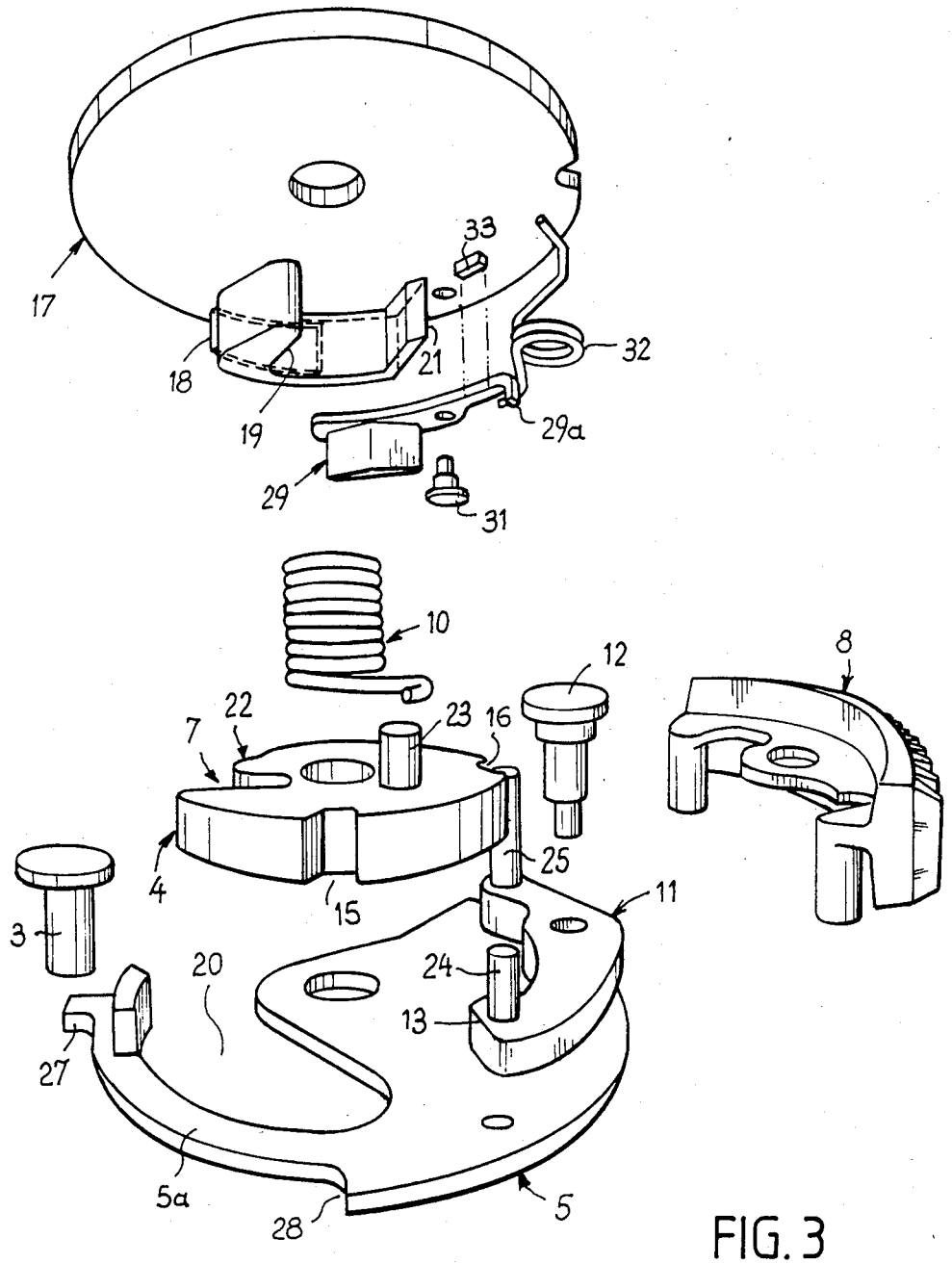
FIG. 3 is an exploded perspective view of the main component elements of the latch of FIGS. 1 and 2.

The latter comprises in combination the following main elements:

(a) a disc 5 rotatably mounted on a pin 6 which is fixed transversely to the two opposite walls 1*a*, 1*b* of the case, and on which the bolt 4 is also rotatably mounted; an opening 20 is provided in the disc 5 to permit the keeper 3 to engage therein, and a notch 7 is provided in the bolt 4 for receiving the keeper 3 at the beginning of a closing cycle;

(b) means for driving the bolt 4 in rotation in either direction during the latch closing and opening cycles, these means comprising in the presently-described embodiment a toothed sector 8 integral with the disc 5 and capable of being driven in rotation by an electric motor M (FIG. 15), the output shaft 9 of which is shown in FIGS. 1 and 2;

(c) a pawl 11 pivotally mounted on the disc 5 by a transverse pin 12 and provided with a projecting head portion 13 biased by an elastically yieldable means 26 constituted, in the presently-described embodiment, by a spring coaxial with the pin 12; this spring 26 tends to cause the head portion 13 of the pawl 11 to enter one of two recesses 15, 16 provided in the bolt 4 when this recess is in facing relation to the head portion 13, so as to establish in this way the connection for driving the bolt 4 by means of the disc 5;

(d) a device for controlling the motor M capable of being actuated by the pawl 11 at the beginning of a closing cycle, so that the entry of the head portion 13 of the pawl 11 in the recess 15 actuates this device, which then causes the rotation of the motor M in a first direction and consequently the rotation of the disc 5 and the bolt 4 (counter-clockwise direction, as viewed in FIGS. 4 to 7) until the complete closure is reached with disengagement of the pawl 11 relative to the control device, means also being provided, cooperative with the pawl 11, for automatically causing the stoppage of the motor M at the end of a latch opening cycle;

(e) a safety disc 17 rotatable about the same rotating pin 6 as the bolt 4 and the first disc 5, this safety disc 17 being normally locked against rotation in the case 1 and being capable of being manually unlocked in the event of a breakdown of the electric circuit of the motor M so as to be driven in rotation manually; the safety disc 17 is elastically biased by a return spring 10 coaxial with the pin 6 and carries fixed ramps 18, 19, 21, which rotate with the disc 17; these ramps 18, 19, 21 are so arranged as to be capable of causing, in the latch closing position, the pivoting of the pawl 11 so that its head portion 13 is withdrawn from the recess 15 of the bolt 4 and releases the bolt 4 from the pawl 11, and then driving the bolt 4 in rotation in the opening direction to an automatically opened angular position (FIG. 6) in which the keeper 3 assumes a driving function and drives the bolt 4 to the complete opening of the door; the ramps 18, 19, 21 are so arranged as to permit the manual opening or closing of the latch irrespective of the respective positions of the component elements of the latch, and in particular of the pawl 11 and the bolt 4 at the moment the electric breakdown occurs.

There will now be described in more detail the various component parts of the latch according to the invention.

Figure 18:
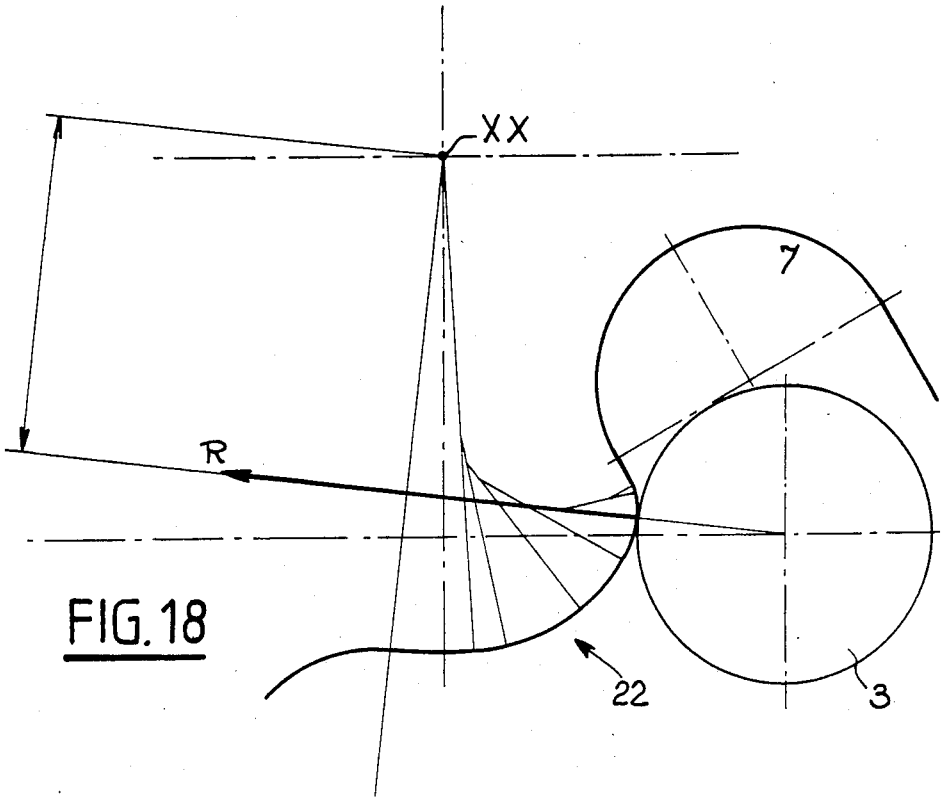
Figure 19:
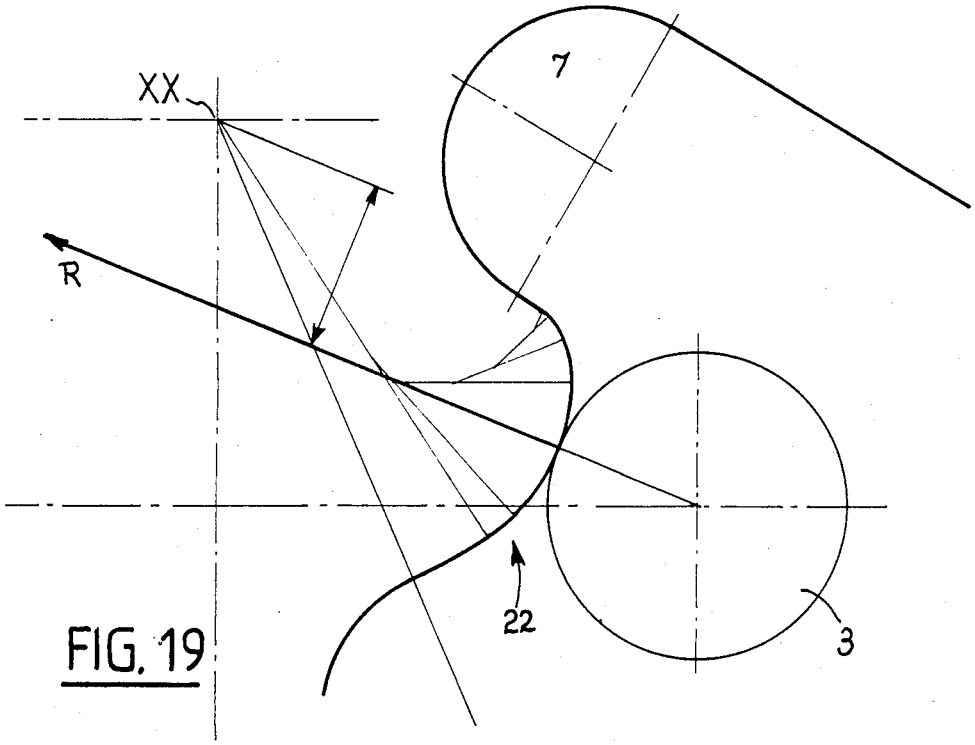

The notch 7 of the bolt 4 is extended by a cam 22 whose profile has been arranged to cooperate with the keeper 3 during the opening and closing cycles and whose radius of curvature progressively increases from the edge of the notch 7 so that the centres of curvature C1, C2, C3, C4, C5 (FIGS. 16 to 20) of the successive sectors S1, S2, S3, S4, S5 of the cam 22 approach the geometric axis X—X of the bolt 4 until the last C5 is placed on the axis X—X itself. Consequently, the direction of the resisting force R of the keeper 3 against the bolt 4 (FIG. 17), which is first of all remote from the axis of rotation X—X of the latter when the keeper 3 is engaged in the notch 7, progressively approaches it (FIGS. 18 and 19) during the latch closing operation, the bolt 4 turning in the counter-clockwise direction until this resisting force R passes substantially through the axis X—X at the end of the cam 22 (FIG. 20) after the whole of the cam 22 has rolled on the keeper 3 and the fully closed position has been reached.

It will be found that, with this geometry of the cam 22, the successive centres of curvature C1, C2 . . . move along a curve C which extends from the edge of the notch 7 to the axis X—X of rotation of the bolt 4.

The bolt 4 is provided with a stud 23 on which bears one end of a spring 10 for returning the bolt 4 in rotation in the clockwise direction (as viewed in FIG. 1), the other end of the spring 10 bearing against the fixed ramp 19 of the disc 17.

The head portion 13 of the pawl 11 carries a finger member 24 while the opposite end of the pawl 11 carries another finger member or stud 25. A spring 26 (FIG. 1)

one end of which is anchored in the disc 5 while the opposite end bears against the portion of the pawl 11 located between the pin 12 and its head portion 13, biases the pawl 11 in rotation so as to tend to cause its head portion 13 to enter either of the recesses 15 and 16.

The rotation pin 12 of the pawl 11 is carried by the disc 5 which is rotatively mounted on the pin 6 which is common to this disc and the bolt 4. Apart from the toothed sector 8, the disc 5 is provided with a first peripheral ramp 27 arranged at the end of its arm 5*a* defining an edge of the opening 20, and a second ramp 28 projecting radially as the first ramp 27, is provided substantially at the base of the arm 5*a*. The function of the ramps 27, 28 will be explained hereinafter when describing the operation of the latch.

The safety disc 17 is biased by its return spring 10 to its inoperative angular position shown in FIG. 1 and this disc 17 carries a ramp 29 which is rotatably mounted on a pin 31 fixed to the disc 17. The ramp 29 is elastically returned by a spring 32 against an abutment 33 fixed to the disc 17, the spring 32 having for this purpose one end connected to the disc 17 and its opposite end bearing against an end portion 29*a* of the ramp 29. The latter is cooperative with the stud 25 of the pawl 11 so as to be driven by this stud in rotation against its return spring 32 during a latch closing cycle, while, during the opening cycle, the stud 25 slides against the ramp 29 which is locked against this abutment 33 and causes the disengagement of the head portion 13 from the recess 15 in the bolt 4. In order to facilitate this disengagement, the edge 15*a* of the recess 15 which is the closest to the notch 7 is divergent in the same way as the corresponding edge 16*a* of the second recess 16.

The spring 32 tends to rotate the ramp 29 in the clockwise direction, as viewed in FIG. 1, so that this ramp 29 is located in a position of rest against the abutment 33, this position being shown in FIG. 1.

The fixed ramp 21 of the disc 17 is adapted to be capable of raising the head portion 13 (FIG. 11) out of the recess 15, at the beginning of the rotation of the disc 17 by acting on the stud 24 fixed to the head portion 13. The second fixed ramp 19 is adapted to be then capable of driving the bolt 4 in rotation in the clockwise direction (FIGS. 11 and 12) of the opening of the latch, by acting on the lug 23 integral with the bolt 4, while the head portion 13 of the pawl 11 comes to bear in the second recess 16 at the end of the opening of the latch (FIG. 14) by the safety disc 17. The third fixed ramp 18 is so positioned as to be capable of disengaging the pawl 11 from the bolt 4 irrespective of the positions of the component elements of the latch, in the event of an electric breakdown. A fourth ramp 60, integral with the member carrying the fixed ramps 19 and 20, is formed between the latter and externally.

The safety disc 17 is normally locked against rotation in the case 1 by a lever 34 pivotally mounted outside the case and which extends through the latter and a slot (not seen in the drawing) in the safety disc 17. Manual driving means are provided for driving the disc 17 in rotation after a manual unlocking by a pivoting of the lever 34, for example as in the embodiment illustrated in FIG. 2, by means of a stud 35 integral with the disc 17 and projecting out of the case 1 through a circular slot (not shown) in the latter. The stud 35 may be driven in rotation with the disc 17, by an actuating lever 36 pivotally mounted on a support 37 integral with the case 1. The lever 36 is journalled on a pin 38 carried by the support 37 and has at the end opposed to the stud 35 an aperture 39 adapted to cooperate with a control rod (not shown).

As a modification, the finger member 38 and the lever 36 could be replaced by a bevel gear system which would have the advantage of permitting the driving of the disc 17 through a larger angular sector than the slot provided in the rear wall 1*b* of the case 1.

The toothed sector 8 (FIGS. 1 and 3) cooperates with a worm integral with a gear worm wheel 42 engaged with a second worm 43 integral with the shaft 9 of the electric motor M. The device controlling the latter further comprises a lever 44 pivotally mounted on a pin 45 carried by the case 1 and having an end portion 44*a* biased by the pawl 11 when the head portion 13 of the latter is not in one of the recesses 15, 16 of the bolt 4, and the disc 5 carrying this pawl 11 is in the position shown in FIG. 1, termed the electrical position of rest. The other end portion 44*b* of the lever 44 is cooperative with the control lever of a first microswitch A (FIGS. 1 and 15), and the lever 44 is subjected to a torque due to a spring (not shown) in order to avoid complicating the drawing) which tends to turn this lever 44 in the counter-clockwise direction, as viewed in FIG. 1.

The pin 45 carries a second lever 46 which is therefore pivotable, on one hand on the pin 45, and which, moreover, is pivotally mounted by a pin 47 on a bar 48. The lever 46 has an end portion 46*a* which is cooperative with either one of the projecting ramps 27, 28 of the disc 5 and is maintained in one of two stable positions by a bistable spring 49. Corresponding to each of these bi-stable positions is therefore a position of the bar 48 which, bears or does not bear against through its head portion 48*a*, 48*b*, the levers of the two microswitches A and B (FIGS. 1 and 15).

Figure 15:
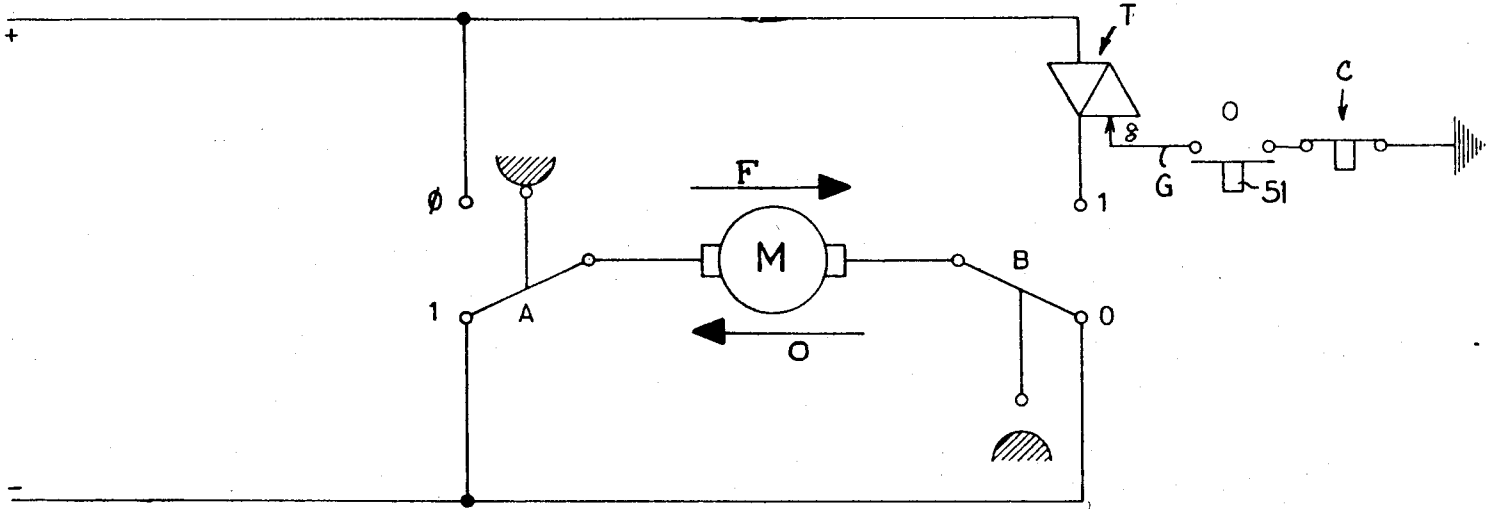
FIG. 15 is a diagram of the electric circuit of the latch controlling motor.
Figure 16:
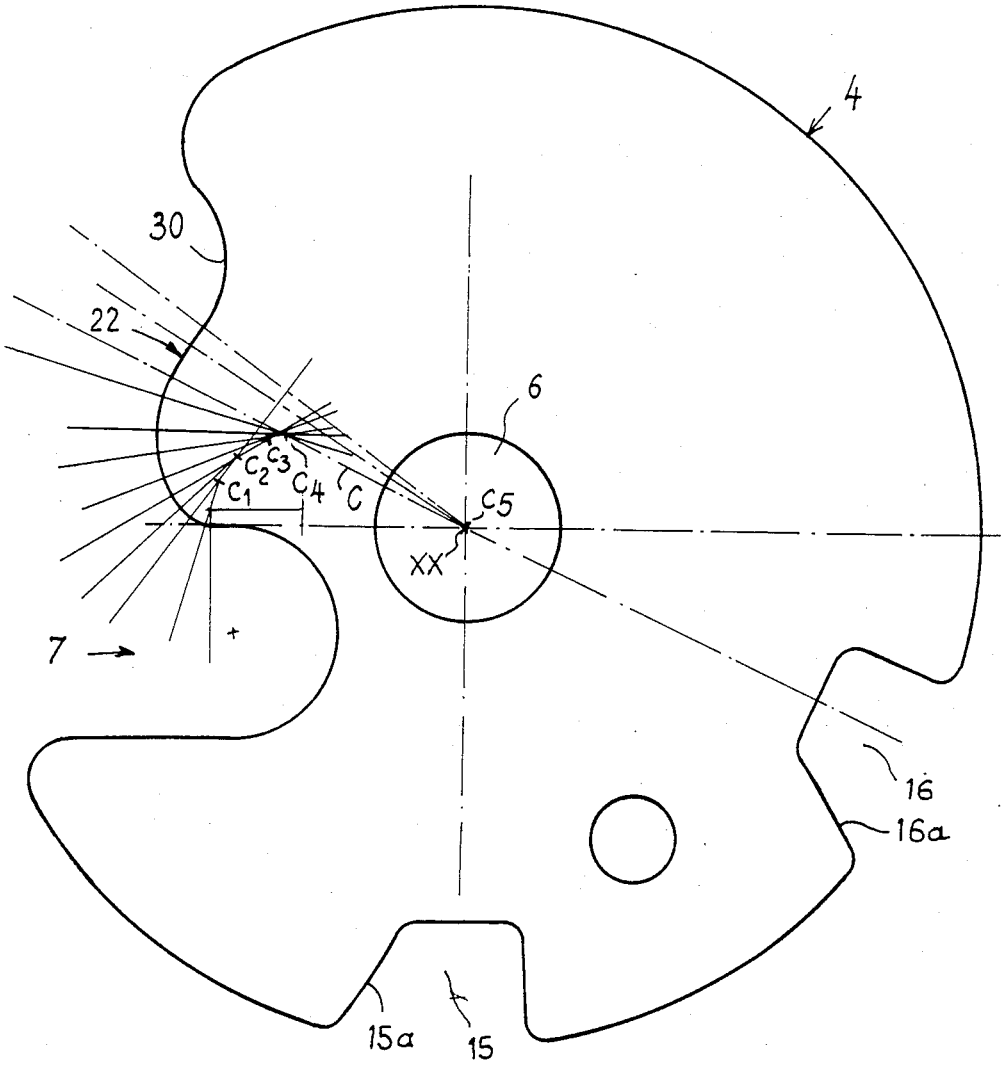
FIG. 16 is a plan view to an enlarged scale of the bolt of the latch according to the invention, showing in particular the manner in which the geometric profile of the cam cooperating with the keeper is determined.

The electric circuit of the motor M (FIG. 15) is provided with a switch T associated with a locking or releasing control C and with a manual button 51 whereby it is possible to cause the opening of the switch T (advantageously formed by a "Triac"), when the last order given to the control C is a releasing order, a depression on the button 51 causing the switch T to pass current and causing the starting up of the motor in the opening direction indicated by arrow 0 in FIG. 15. The switch T is provided with a trigger G which may be opened by bearing on the manual button 51 provided this button is not inhibited by a locking order given to the control T. The condition of the electric circuit illustrated in FIG. 15 is that in which the door is open, the microswitch A being in its position 1, the microswitch B being in its position 0, so that the motor M is not supplied with current (part V of the time chart shown in FIG. 21).

Operation of the latch according to the invention (1) Closure: FIGS. 4 to 7.

FIG. 4 shows the position of the main component elements of the latch when the door is open: the keeper 3 is located outside the latching opening 20, the pawl 11 is raised, its head portion 13 bearing against the edge of the bolt 4 between the recesses 15 and 16. The head portion 13 bears against the lever 44 which bears by its end portion 44*b* against the microswitch A. The electric circuit is in the position shown in FIG. 15 with the motor M receiving no current.

FIG. 5: the door is closed. The keeper 3 enters the notch 6 and causes the bolt 4 to rotate in the counter clockwise direction against the torque exerted by its return spring 10 until the head portion 13 of the pawl 11 drops into the recess 15 of the bolt 4, while the keeper 3 exerts on the latter a resisting force R due to the beginning of the compression of the sealing elements around the door. The cam 22, the notch 7 and the keeper 3 are at this moment in the position shown in FIG. 17, termed the first safety position, the reaction of the sealing elements and the resisting force R being relatively small, R being remote from the geometric axis of rotation X—X of the bolt 4. The lever 44 pivots as a result of the introduction of the head portion 13 into the recess 15, and releases the microswitch A which assumes its position 0 (FIG. 15). The motor M is supplied with current in the closing direction F and drives, through its kinematic driving train 9, 43, 42, 41, 8, the disc 5 in the counter clockwise direction.

FIG. 6: in the course of closing, the keeper 3 is biased by the cam 22. As the keeper 3 enters the latch and the reaction of the sealing element $R_j$ increases (FIG. 22), the cam 22 assuming relative to the keeper 3 its positions shown in FIGS. 18 and 19, the reaction R approaches the axes X—X and 6 and progressively increases the reduction (angular travel of the bolt 4/linear travel of the keeper 3) and thus decreases the ratio (reaction of the sealing element $R_j$/resisting torque $C_m$ of the bolt 4). There are thus obtained the two curves $R_j$ and $C_m$ of FIG. 22.

It will be noticed that if the reaction of the sealing element $R_j$ varies from 12 to 80 daN, namely a ratio of 6.67, the resisting torque $C_m$ varies from 1.5 to 4 Mkg, namely a ratio of 2.67.

In the course of the closure (FIG. 6), the finger member 25 of the pawl 11 comes in contact with the ramp 29 and rotates it in the counter-clockwise direction against the force exerted by its return spring 32.

Figure 20:
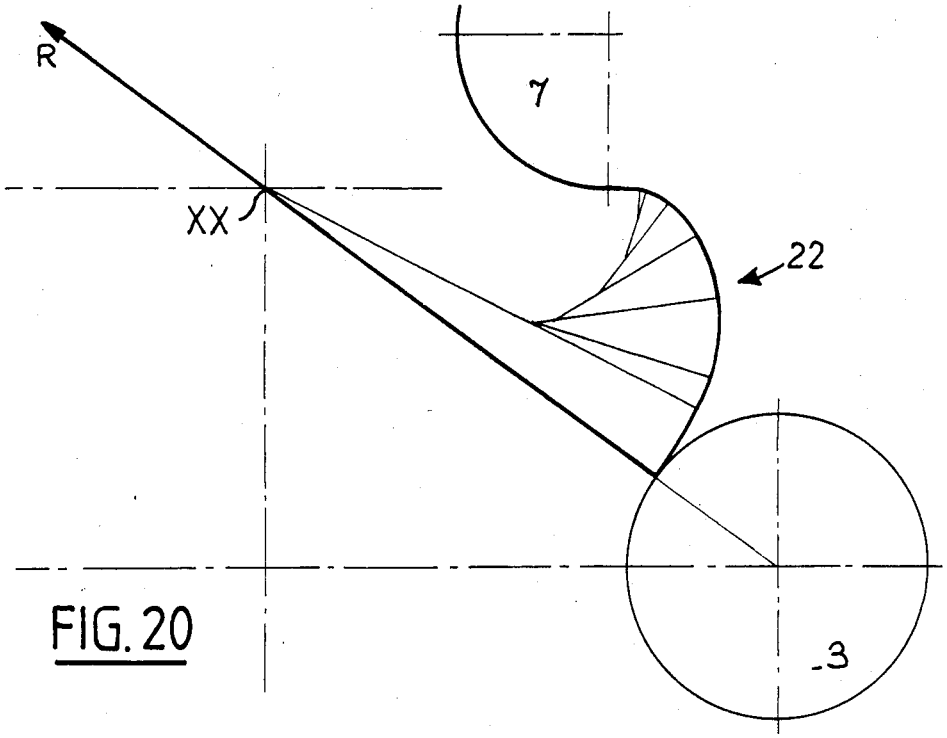

FIGS. 7 and 20: at the end of the closure, the keeper 3 comes to bear against a concave sector 20 extending the cam 22 in which position the resisting force R passes through the axis X—X. The latch is then in the auto-closing position, i.e. the reaction of the sealing elements $R_j$ can no longer alone cause the opening of the latch. At the end of the travel, the ramp 27 comes to bear against the lever 46 and causes it to assume its second position of equilibrium, so that the bar 48, driven by the rotation of the lever 46, bears by its head portions 48*a*, 48*b* against the two microswitches A, B. The microswitch B assumes its position I (FIG. 15), while the microswitch A returns to its initial position I. The motor is then automatically stopped and is ready to be supplied in the opening direction 0 provided the switch T is put into its position for passing the current. The successive stages of the closure of the door and of the state of the electric circuit after closure of the door and stoppage of the motor M are represented by the sequences I, II, III of the time chart of FIG. 21.

It should be noted that the bistable spring 49 has for function to ensure the bearing of the bar 48 on the second microswitch(A or B) when the first microswitch (B or A) has been opened and has stopped the motor M. Thus, the spring 49 urges the bar 48 toward the left after the lever 46 has begun to be driven by the ramp 27 guarantees the opening of the two microswitches A and B and therefore the putting of the latch in the open position.

Figure 8:
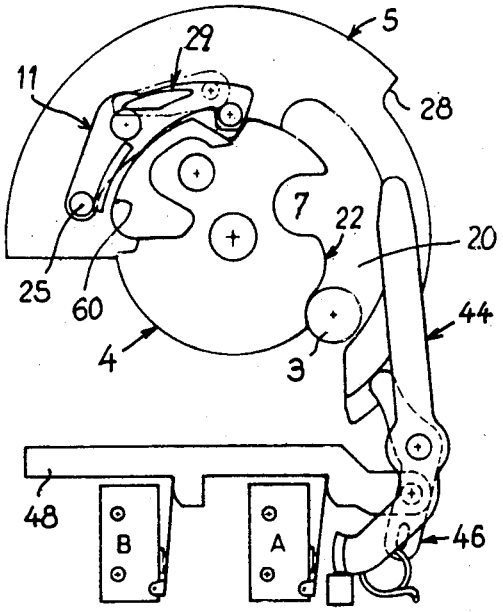
FIGS. 8, 9 and 10 are views similar to FIGS. 4 to 7 illustrating the successive stages of a latch opening cycle.
Figure 9:
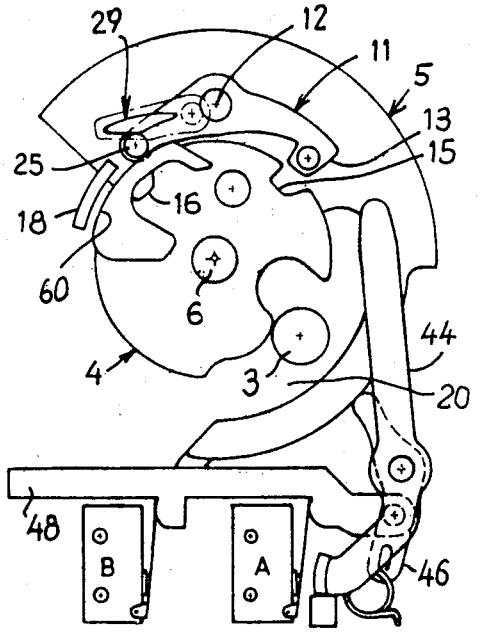
Figure 10:
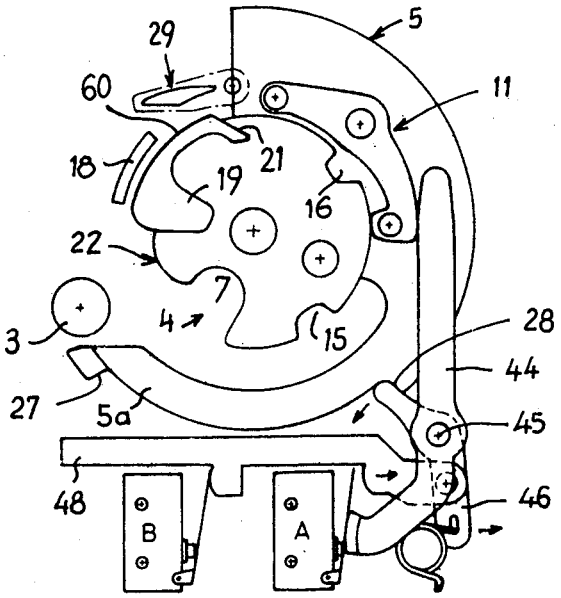

(2) Latch opening sequence: FIGS. 8, 9 and 10.

If the opening button 51 is depressed, and provided the last order given to the control C is not a locking order, an impulse is produced on the trigger G of the switch T which is put into the current passing position. The motor M is then supplied with current in the opening direction 0 (FIG. 15).

As the latch is initially in the same state (FIG. 8) as at the end of the closing operation (FIG. 7), the disc 5 starts to rotate in the clockwise direction. The pawl 11 has its head portion 13 maintained in the recess 15 by the ramp 18 on which bears indeed the finger member 25 of the pawl 11, and therefore consequently the head portion 13 cannot be disengaged from the recess 15. The pawl 11 driven by the disc 5 then itself drives in rotation the bolt 4 in the opening direction, the cam 22 starting to roll on the keeper 3 from its position of FIG. 20 toward that of FIG. 19.

FIG. 9: after an angular travel of about 30°, the assembly comprising the bolt 4 and the keeper 3 is again in the auto-opening position, i.e. the keeper 3, under the effect of the reactions of the sealing element $R_j$, can drive the bolt 4 in the opening direction. The finger member 25 then slides under the ramp 29 blocked against the abutment 33, which causes the pivoting of the pawl 11 about its pin 12 and disengages the head portion 13 from the recess 15.

This enables the bolt 4 to rotate freely under the thrust exerted by the keeper 3 so that the latch is opened and releases the keeper 3 (FIG. 10) while the disc 5 finishes its rotation. At the end of the travel of the disc 5, its ramp 28 comes to bear against the lever 46 which pivots about its pin 45 and drives the bar 48 to the right as viewed in FIG. 10, while the head portion 13 of the pawl 11 comes to bear against the lever 44. The latter pivots about the pin 45 and its end portion 44*b* bears against the microswitch A which cancels out the effect on the latter of the displacement toward the right of the bar 48. Consequently, only the microswitch B is released, and therefore assumes its position 0 while the microswitch A remains in its position I. The supply to the motor M is therefore automatically cut off and the electric circuit is again in the illustrated position (FIG. 5), which it occupied before the closure. The state of the electric elements during one opening cycle is indicated in the time chart of FIG. 21 (sequence IV corresponding to FIGS. 8 to 10).

(3) Operation of the latch in the event of an electric breakdown: FIGS. 11 to 14.

If the breakdown of the electric circuit occurs when the door is closed and the latch is therefore in the situation illustrated in FIG. 7, the lever 44 is pivoted downwardly (FIG. 2) so as to unlock the safety disc 17. Then, by means of the lever 36, which is pivoted so as to drive the finger member 35, the disc 17 is made to rotate in the clockwise direction (as viewed in FIG. 11). The rotation of the disc 17 therefore drives the ramps 19, 18, 21, 29 fixed to this disc.

First of all, the inclined ramp 21 raises the stud 24 of the pawl 11 (FIG. 11) so that the head portion 13 leaves the recess 15 and the bolt 4 is released from the pawl 11. As the disc 17 continues to rotate, the ramp 19 comes into contact with the stud 23 which then drives in rotation in the clockwise opening direction the bolt 4. The ramp 60 prevents the pawl 11 from falling back into the recess 16 in the bolt 4 when the latter rotates under the effect of the thrust exerted by the keeper 3 so that the latch is allowed to be opened.

After the pawl has reached its auto-opening position (FIG. 12), the keeper 3 becomes capable of driving and enters the notch 7 and then leaves the latter and the door is opened. The disc 17 is then biased rearwardly by its spring 10 while the bolt 4 reaches its position shown in FIG. 4, the door being opened. However, the disc 17 cannot resume its initial position of rest, since the disc 5 is in the "closed door" position, the pawl 11 bearing by its head portion 13 on the bolt 4 in the raised position. Consequently, the stud 25 which normally slides on the ramp 18 when the head portion 13 of the pawl 11 is anchored in a recess 15, 16 in the bolt 4, then interferes with this ramp 18 (FIG. 13) and therefore prevents the disc 17 from returning to its position of rest. This disc 17 then returns to a position close to its position of rest, and the pawl 11 falls back onto the outer part of the bolt 4.

Figure 17:
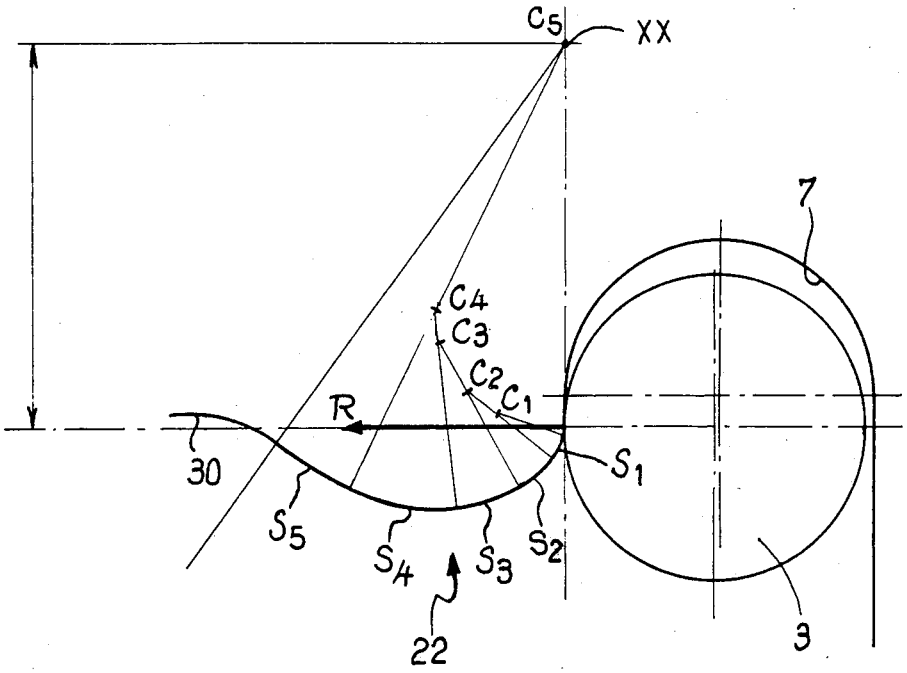
FIGS. 17 to 20 are plan views of the cam and of the notch in the bolt and of the associated keeper, showing the various relative positions of the cam and keeper during a latch closing operation.

On the next slamming of the door, the bolt 4, which is urged by the keeper 3, then comes to the position of FIG. 9 (position which is termed a first safety position also corresponding to FIG. 17), the head portion 13 of the pawl 11 dropping to the recess 16, termed "safety recess". The keeper 3 then cannot urge the bolt 4 sufficiently to cause the head portion 13 to drop into the first recess 15. The latch is then locked in a position corresponding to the "first safety" position on a conventional latch. As the pawl 11 has pivoted into the recess 16, the stud 25 moves away from the path of the ramp 18 and thus allows the safety disc 17 to resume its position of rest under the effect of its return spring 10.

It is always possible, irrespective of the position of the component elements of the latch at the moment of the electric breakdown, to open the latch after having unlocked the safety disc 17 by action of the ramp 21 on the stud 24 for releasing the bolt 4. If the position is the auto-closing position, the stud 23 is urged by the ramp 19 and the latch is opened when the auto-opening point is reached. If the position is still the auto-opening position, it is sufficient to raise the stud 24 by the ramp 21 to release the bolt and open the latch under the effect of the thrust of the keeper. In any case, it will thereafter always be possible, by slamming the door, to close the door manually. Upon slamming, the keeper 3 will come to rotate the bolt 4 in the counter-clockwise direction and, depending on the angular position of the disc 5, and therefore of the pawl 11, the head portion 13 will always be able to drop into either one of the recesses 15 or 16 of the bolt 4.

Figure 21:
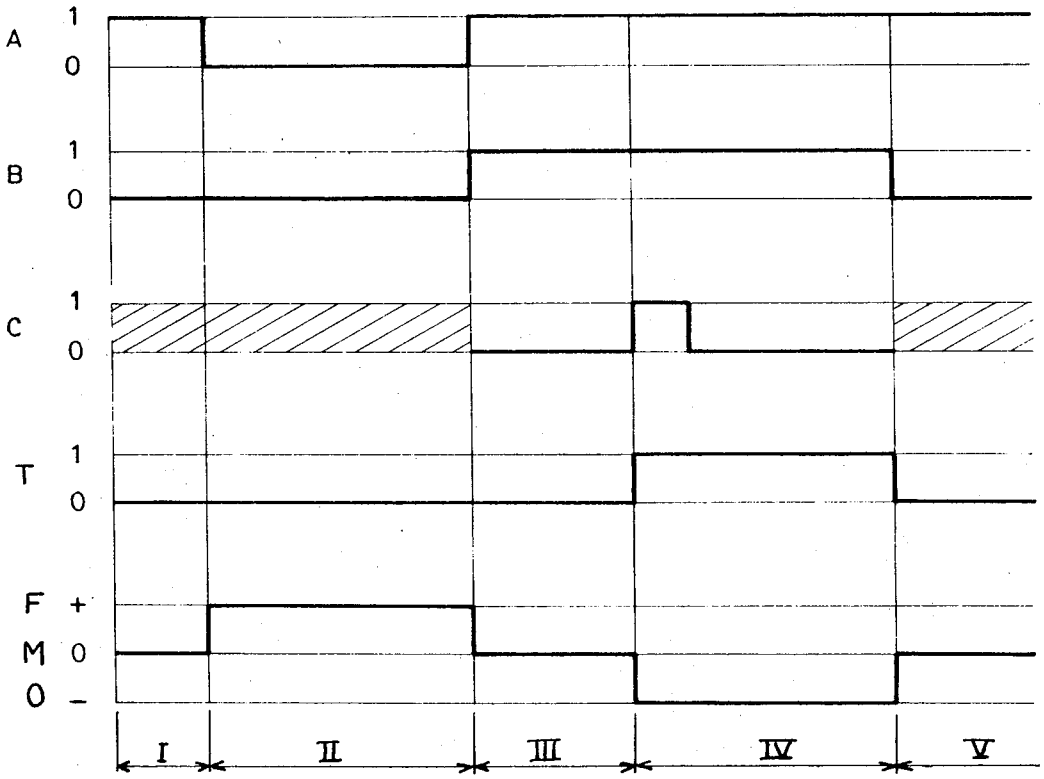
FIG. 21 is a time chart representing the state of the various electric elements of the latch during a closing and then an opening stage.

In FIG. 21, the cross-hatched parts signify that the state of the corresponding contacts has no effect on the state of the circuit. The parts I and V of the time chart represent the same state of the electric system (waiting for a closing order).

Figure 22:
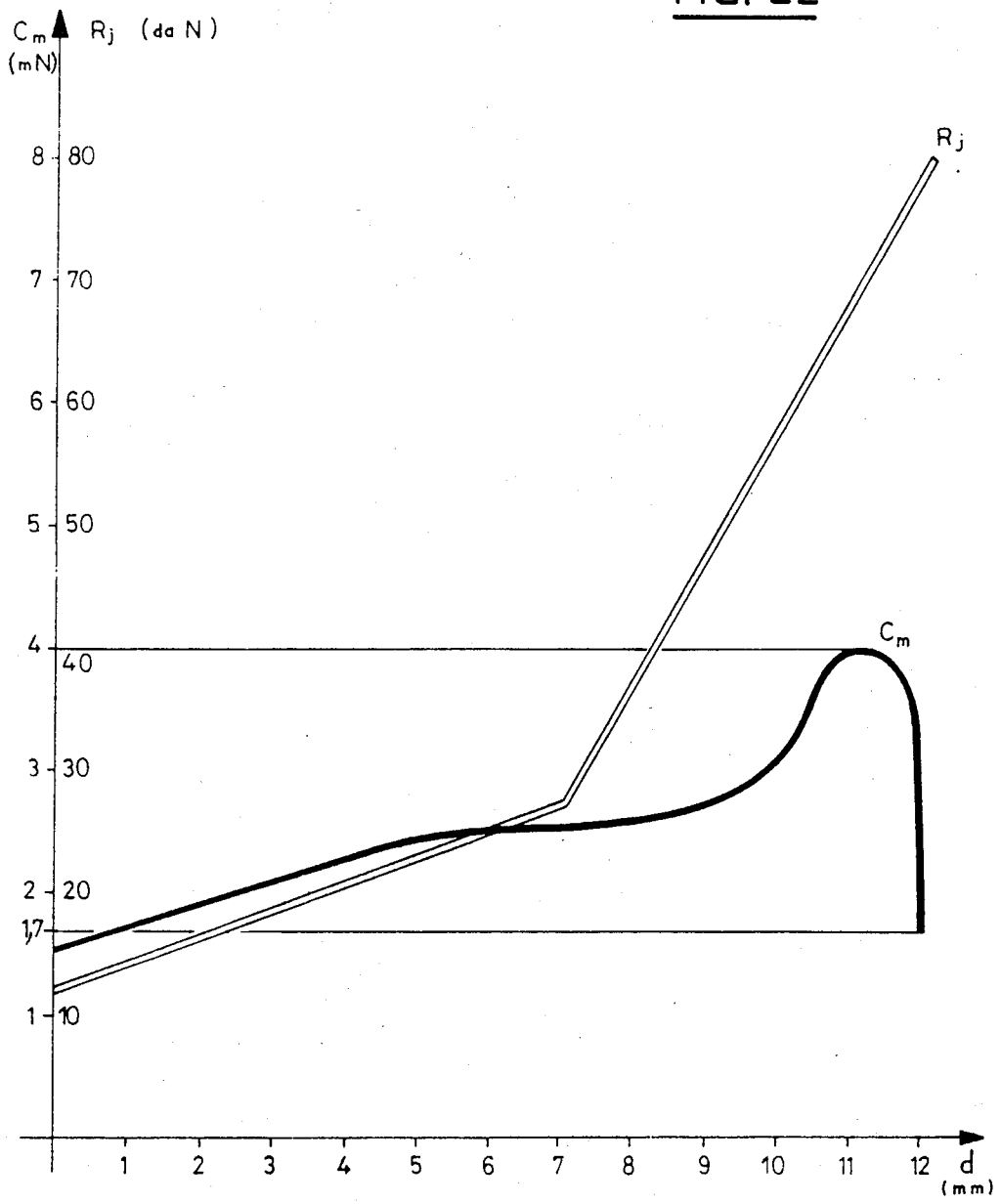
FIG. 22 is a diagram illustrating the evolution of the reaction of the sealing element and of the resisting torque on the bolt as a function of the position of the keeper.

The latch according to the invention has, in addition to the advantages already mentioned, the following advantages:

The geometry of the cam 22 permits achieving a progressive development of the forces, and therefore to decrease the influence of the variations of the forces of the reaction of the sealing element $R_j$, as seen in FIG. 22. This permits the use of an electric motor M which is less powerful and therefore less consumptive of energy and operating the motor under a more constant resisting torque which results in a decrease in shocks and jerks, and consequently an increased duration of life.

On the other hand, the tensile forces exerted by the bolt 4 on the keeper 3 at the beginning of the closure remain small. If a foreign body is slipped between the door and the keeper, and provided that this object is relatively thick (in particular the fingers of a hand), the blocked torque of the motor M will be reached for a force which remains small in the region of the door, which substantially avoids any danger of serious injury by the crushing of a finger of a passenger.

The geometry of the bolt 4 permits obtaining the two closing and safety positions required by regulations. It has, in the closing position, the originality of not being subjected to a torque tending to drive it in the opening direction, irrespective of the forces of the keeper 3 and consequently an improved safety in the case of accident.

This latch requires only one motor for closing the door and opening the latch owing to the kinematic chain actuating the bolt 4. This kinematic chain also permits the mechanical achievement of the closure of the door and the opening of the latch in the event of an electric breakdown irrespective, as mentioned before, of the position of the various component elements when the breakdown occurs.

The electric circuit advantageously comprises a judicious control of the microswitches or contactors A, B.

The overall size of the latch according to the invention, taking into account its functions, remains compatible with a placement in doors having present-day dimensions, owing to the compactness of the kinematic chain and to the disposition of the motor without involving considerable additional costs.

It will be noted that the kinematic chain 9, 43, 42, 41, 8 is irreversible, which avoids, in the event of a manual closure in the auto-opening bolt/keeper position, the rotation of the assembly 4, 11, 5, 8 under the effect of the thrust exerted by the keeper 3 on the bolt due to the reactions of the sealing elements of the door.

Further, the cam 22 or the latching profile permits evening out the variations in the forces due to the reactions of the sealing elements of the door as concerns the motor torque on the fork and therefore on the motor (FIG. 22).

Lastly, the means for unlocking and driving in rotation the safety disc 17 illustrated by way of example in FIG. 2, may be replaced by a system permitting, in a single movement and by means of the same element, this unlocking and this driving in rotation.

What is claimed is:

1. A latch which is electrically opened and closed, in particular for a door of an automobile vehicle having a body, the latch comprising a case for fixing to the door, in which case is provided a cavity, a keeper for mounting on said vehicle body, a bolt mounted in the case and capable of being driven by the keeper so as to close the latch, the latch further comprising in combination:

(a) a pin fixed to the case, a first disc and the bolt being rotatably mounted on the pin, the disc defining an opening for allowing the keeper to engage therein, and a notch in the bolt for receiving the keeper at the beginning of a closing cycle;

(b) means for driving the bolt in rotation in either direction during latch closing and opening cycles, said means comprising a toothed sector integral with the disc, an electric motor having an electric supply circuit, and a kinetic chain drivingly connecting the motor to the sector;

(c) two spaced-apart recesses in the bolt, a pawl pivotally mounted on the disc and having a projecting head portion, an elastically yieldable means combined with the pawl to bias the head portion of the pawl to enter one of the two recesses in the bolt when said one recess is positioned in facing relation to the head portion so as to establish a connection for driving the bolt in rotation by means of the disc;

(d) a control device for controlling the motor and cooperative with the pawl for actuation by the pawl at the beginning of a latch closing cycle so that the insertion of the head portion of the pawl in one of said recesses of the bolt actuates said device which then causes rotation of the motor in a first direction and consequently rotation of the disc and the bolt until complete closure of the latch with a disengagement of the pawl relative to the control device, and means further cooperative with the pawl for automatically causing stoppage of the motor at the end of a latch opening cycle;

(e) a safety disc rotatably mounted on said pin, means for normally locking the safety disc against rotation relative to the case, means for manually unlocking the safety disc relative to the case in the event of breakdown of the electric supply circuit of the motor and driving the safety disc in rotation, fixed ramps carried by the safety disc and so adapted and arranged as to be capable, from any position of the bolt, the first disc and the pawl, for example from a latch closing position, of pivoting the pawl and causing the head portion of the pawl from withdrawing from said one of said recesses of the bolt so as to release the bolt from the pawl, then driving the bolt so as to release the bolt from the pawl, then driving the bolt in rotation in a latch opening direction to an automatically opening angular position in which the keeper assumes a driving function and drives the bolt to a complete opening of the door, the disc and the ramps also permitting the closure of the latch from the latch opening position or from an intermediate position.

2. A latch according to claim 1, comprising a cam which extends the notch of the bolt and is cooperative with the keeper during the latch opening and closing cycles and has a radius of curvature which progressively increases from an edge of the notch in such manner that centres of curvature of successive sectors of said cam approach said pin and the direction of a resisting force of the keeper against the bolt is first of all remote from said pin and progressively approaches said pin until it substantially passes through said pin at an end of the cam.

3. A latch according to claim 1, wherein the control device of the motor comprises a second pin carried by the case, a lever pivotally mounted on the second pin, elastically yieldable return means for the lever, the lever having a first portion cooperative with the pawl so as to be biased by the pawl when the head portion of the pawl is outside said one of the bolt, in opposition to action of the elastically yieldable return means for the lever, and a second end portion opposed to said first end portion of the lever, a first microswitch in said supply circuit, the second end portion of the lever being cooperative with the microswitch so as to close the microswitch by a pivoting of the lever about said second pin following on entry of the head portion of the pawl in a recess of said recesses of the bolt at the beginning of a latch closing cycle, said microswitch causing at this moment the supply of power to the motor through said supply circuit and the rotation of the disc in the latch closing direction.

4. A latch according to claim 3, wherein the control device of the motor comprises a bar movable between two positions, a bistable spring combined with the bar, a second microswitch in said supply circuit, a second lever which is pivotally mounted on said second pin and pivotally mounted on the bar, two ramps on the first disc cooperative with the second lever, the bistable spring being operative to maintain the bar in either one of said two positions, the bar being capable of causing, in one of said two positions, the opening or the closure of the second microswitch and of the first microswitch under the action of a respective one of said two ramps on said second lever at the end of the latch opening or closure, so as to automatically cut off the supply of the motor through said supply circuit at the end of a latch opening or closing cycle.

5. A latch according to claim 4, wherein the electric supply circuit of the motor comprises a third switch, a fourth switch which is associated with the third switch and of the push-button type, and a selectively locking and unlocking control associated with the fourth switch and operative to open the fourth switch when the last order given to said control is an unlocking order, a force exerted on the button causing the third switch to allow through current and causing the starting up of the motor in the latch opening direction.

6. A latch according to claim 1, further comprising a return spring associated with the safety disc for returning the safety disc to an inoperative angular position, a pin and an abutment fixed to the safety disc, means defining a third ramp pivotally mounted on the pin fixed to the safety disc, elastically yieldable means associated with the third ramp for returning it against the abutment fixed to said disc, and a stud integral with the pawl, the third ramp being cooperative with the stud so as to be driven by the stud in rotation against its elastically yieldable return means during a latch closing cycle, while, during a latch opening cycle, the stud is slidable against the third ramp which is held in position by the abutment and is then operative to cause the disengagement of the head portion of the pawl from the respective recess of the bolt.

7. A latch according to claim 1, wherein a first of said fixed inclined ramps is capable of raising the head portion of the pawl out of the recess of the bolt at the beginning of the rotation of the safety disc, a second of said fixed ramps is capable of thereafter driving the bolt in rotation in the latch opening direction until there is reached a "automatically opening" point beyond which the keeper is capable of rotating the bolt to the complete opening of the latch, a third ramp contiguous with the first ramp being cooperative with the pawl for maintaining the pawl in a raised position by preventing it from dropping into the recess of the bolt when the bolt is rotated under the thrust of the keeper.

8. A latch according to claim 7, comprising a finger member integral with the pawl through which finger member the first of said fixed ramps is capable of raising the head portion of the pawl out of the recess of the bolt.

9. A latch according to claim 7, comprising a lug integral with the bolt, on which lug said second of said fixed ramps is capable of acting for driving the bolt in rotation in the latch opening direction.

10. A latch according to claim 1, comprising a slot in the safety disc, a lever pivotally mounted outside the case and extending through the case and the slot in the safety disc for normally locking the safety disc against rotation in the case, and means for manually driving the safety disc in rotation after unlocking by said lever.

11. A latch according to claim 10, wherein said means for driving the safety disc in rotation comprise a stud integral with the disc and projecting from the case through a circular slot in the case, an actuating lever pivotally mounted on a support integral with the case being cooperative with said stud and the safety disc for driving the safety disc in rotation.

* * * * *